US011634197B2

(12) United States Patent
Castello et al.

(10) Patent No.: US 11,634,197 B2
(45) Date of Patent: Apr. 25, 2023

(54) OFFSHORE STEEL STRUCTURE WITH INTEGRAL ANTI-SCOUR AND FOUNDATION SKIRTS

(71) Applicant: HORTON DO BRASIL TECNOLOGIA OFFSHORE, LTDA., Rio de Janeiro (BR)

(72) Inventors: Xavier Castello, Rio Grande (BR); Marcelo Igor Lourenço de Souza, Rio de Janeiro (BR); Luiz Germano Bodanese, Rio de Janeiro (BR); Rafael Louzada Bodanese, Rio de Janeiro (BR)

(73) Assignee: HORTON DO BRASIL TECNOLOGIA OFFSHORE LTDA., Rio de Janeiro (BR)

( * ) Notice: Subject to any disclaimer, the term of this patent is extended or adjusted under 35 U.S.C. 154(b) by 0 days.

(21) Appl. No.: 17/046,089

(22) PCT Filed: Apr. 8, 2019

(86) PCT No.: PCT/BR2019/050128
§ 371 (c)(1),
(2) Date: Oct. 8, 2020

(87) PCT Pub. No.: WO2019/195909
PCT Pub. Date: Oct. 17, 2019

(65) Prior Publication Data

US 2021/0032827 A1 Feb. 4, 2021

Related U.S. Application Data

(60) Provisional application No. 62/654,483, filed on Apr. 8, 2018.

(51) Int. Cl.
*E02B 17/02* (2006.01)
*B63B 77/00* (2020.01)
*E02B 17/00* (2006.01)

(52) U.S. Cl.
CPC ..... *B63B 77/00* (2020.01); *E02B 17/02* (2013.01); *E02B 2017/0043* (2013.01); *E02B 2017/0047* (2013.01)

(58) Field of Classification Search
CPC ..... B63B 77/00; B63B 35/4413; E02B 17/02; E02B 2017/0043; E02B 2017/0047; E02B 2017/0082
See application file for complete search history.

(56) References Cited

U.S. PATENT DOCUMENTS 3,224,401 A 12/1965 Kobus
4,109,477 A 8/1978 Vogel
(Continued)

FOREIGN PATENT DOCUMENTS

CN 107806108 * 3/2018 ..... E02D 27/425
JP 6026197 B2 11/2016
WO 1981/003191 A1 11/1981

OTHER PUBLICATIONS

PCT/BR2019/050128 International Search Report and Written Opinion dated Nov. 20, 2019 (2951-02101) (16 p.).

*Primary Examiner* — Carib A Oquendo
(74) *Attorney, Agent, or Firm* — Conley Rose, P.C.

(57) ABSTRACT

An offshore structure includes an adjustably buoyant hull including a plurality of vertical columns and a plurality of horizontal pontoons. Each pontoon extends between a pair of the columns. The adjustably buoyant hull is configured to receive a topside. Each column has a central axis, an upper end, and a lower end. Each pontoon has a longitudinal axis, a first end coupled to one of the columns, and a second end coupled to another one of the columns. The offshore struc-
(Continued)

ture also includes a foundation assembly attached to a lower end of the hull. The foundation assembly includes a column skirt extending downward from the lower end of each column and a pontoon skirt extending downward from a bottom surface of each pontoon.

6 Claims, 7 Drawing Sheets

(56) References Cited

U.S. PATENT DOCUMENTS

| | | | | |
|---|---|---|---|---|
| 4,627,767 | A | 12/1986 | Field et al. | |
| 5,190,410 | A | 3/1993 | Nunley | |
| 6,447,208 | B1 | 9/2002 | Huang et al. | |
| 8,668,408 | B2 | 3/2014 | Foo et al. | |
| 2009/0297276 | A1 | 12/2009 | Foo et al. | |
| 2011/0219999 | A1 | 9/2011 | Murray | |
| 2012/0230773 | A1* | 9/2012 | Foo | E02B 17/021 405/224 |
| 2012/0247830 | A1 | 10/2012 | Advocaat et al. | |
| 2014/0305359 | A1 | 10/2014 | Lambrakos et al. | |
| 2020/0115007 | A1* | 4/2020 | Castello | B63B 71/00 |

* cited by examiner

OFFSHORE STEEL STRUCTURE WITH INTEGRAL ANTI-SCOUR AND FOUNDATION SKIRTS

CROSS-REFERENCE TO RELATED APPLICATIONS

This application is a 35 U.S.C. § 371 national stage application of PCT/BR2019/050128 filed Apr. 8, 2019, and entitled "Offshore Steel Structure with Integral Anti-Scour and Foundation Skirts," which claims benefit of U.S. provisional patent application Ser. No. 62/654,483 filed Apr. 8, 2018, and entitled "Offshore Steel Structure with Integral Anti-Scour and Foundation Skirts," each of which is hereby incorporated herein by reference in its entirety for all purposes.

STATEMENT REGARDING FEDERALLY SPONSORED RESEARCH OR DEVELOPMENT

Not applicable.

BACKGROUND

Field of the Disclosure

The disclosure relates generally to offshore structures. More particularly, the disclosure relates to offshore platforms for offshore drilling and/or production operations. Still more particularly, the disclosure relates to deploying and installing bottom-founded offshore platforms.

Background to the Disclosure

There are several types of offshore structures that may be employed to drill and/or produce subsea oil and gas wells depending on the depth of water at the location of the subsea well. For instance, jackup platforms are commonly employed as drilling structures in water depths less than about 400 feet; fixed platforms and gravity based structures are commonly employed as production structures in water depths between about 50 and 800 feet; and floating systems such as semi-submersible platforms are commonly employed as production structures in water depths greater than about 800 feet.

Fixed platforms and gravity based offshore structures typically rely, at least in part, on their weight to resist the lateral environmental loads caused by winds, waves, and currents. In some cases, the foundation of the substructure may include vertically oriented piles or skirts designed to penetrate into the sea floor to enhance stability and resistance to bearing and lateral loads.

BRIEF SUMMARY OF THE DISCLOSURE

Embodiments of offshore structures are disclosed herein. In one embodiment, an offshore structure comprises an adjustably buoyant hull including a plurality of vertical columns and a plurality of horizontal pontoons. Each pontoon extends between a pair of the columns. The adjustably buoyant hull is configured to receive a topside. Each column has a central axis, an upper end, and a lower end. Each pontoon has a longitudinal axis, a first end coupled to one of the columns, and a second end coupled to another one of the columns. The offshore structure also comprises a foundation assembly attached to a lower end of the hull. The foundation assembly includes a column skirt extending downward from the lower end of each column. In addition, the foundation assembly includes a pontoon skirt extending downward from a bottom surface of each pontoon.

Another embodiment of an offshore structure comprises an adjustably buoyant hull. The hull comprises a plurality of vertically oriented columns. The huller also comprises a plurality of horizontally oriented pontoons. Each pontoon is positioned between a pair of the columns. Each column comprises an anti-scour plate extending horizontally from a lower end of the column. In addition, each column comprises a column skirt extending downward from a lower end of the column. Each pontoon comprises an anti-scour plate extending horizontally from the pontoon. Further, each pontoon comprises a pontoon skirt extending downward from a bottom surface of the pontoon.

Embodiments of methods for deploying and installing an offshore structure at an installation site in a body of water are disclosed herein. In one embodiment, a method comprises (a) floating an adjustably buoyant hull to the installation site. In addition, the method comprises (b) transporting a topside to the installation site separately from the hull. Further, the method comprises (c) ballasting the hull into engagement with the sea floor at the installation site after (a). Still further, the method comprises (d) mounting the topside to the hull at the installation site after (c) to form the offshore structure.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those skilled in the art upon reading the following detailed description, and by referring to the accompanying drawings. It should be appreciated that the conception and the specific embodiments disclosed may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of the disclosed exemplary embodiments, reference will now be made to the accompanying drawings, wherein.

DETAILED DESCRIPTION OF PREFERRED EMBODIMENTS

Figure 1:
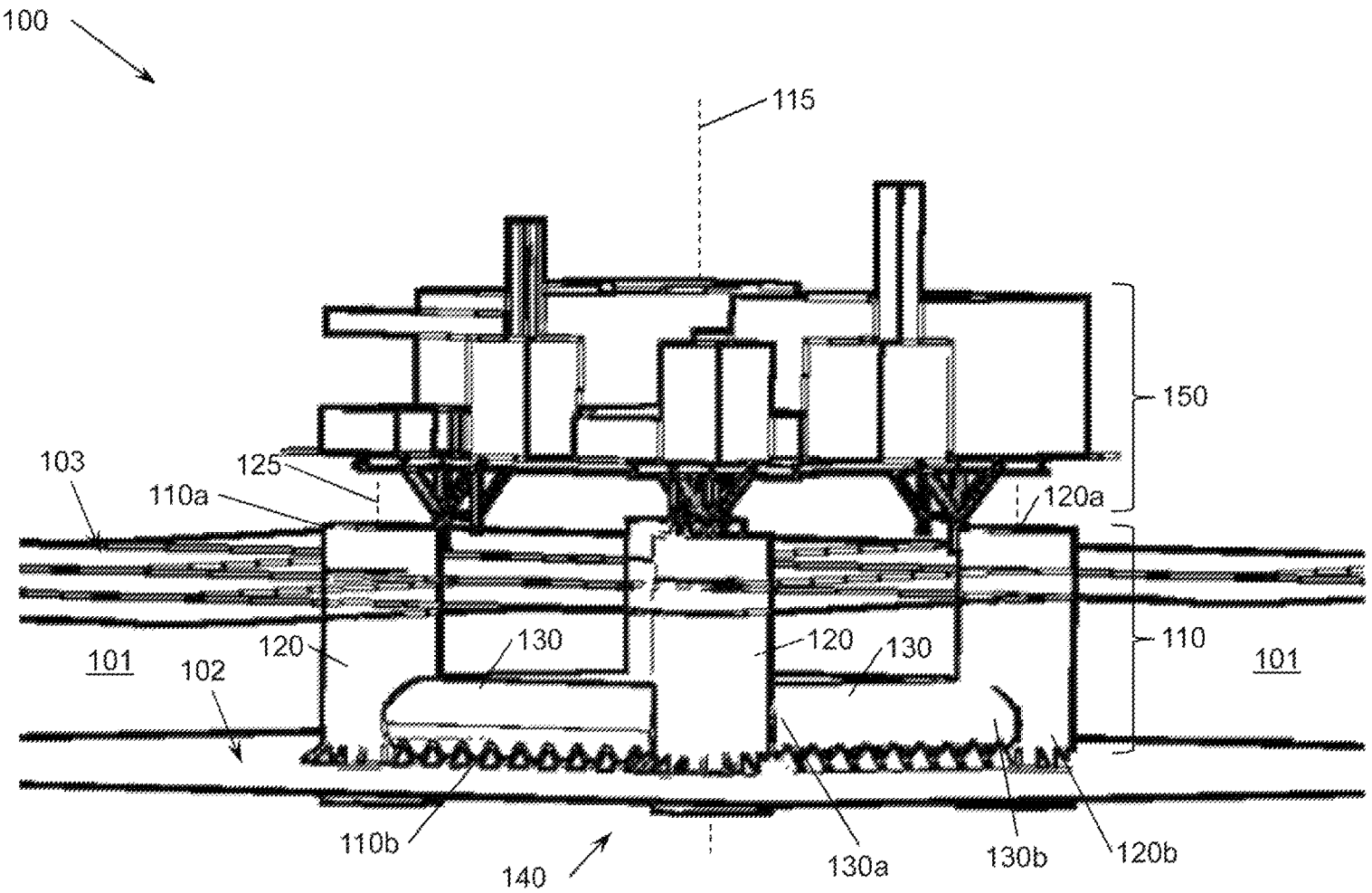
FIG. 1 is a perspective view of an embodiment of a bottom-founded offshore structure in accordance with the principles disclosed herein.

The following description is exemplary of certain embodiments of the disclosure. One of ordinary skill in the art will understand that the following description has broad application, and the discussion of any embodiment is meant to be exemplary of that embodiment, and is not intended to suggest in any way that the scope of the disclosure, including the claims, is limited to that embodiment.

The figures are not necessarily drawn to-scale. Certain features and components disclosed herein may be shown exaggerated in scale or in somewhat schematic form, and some details of conventional elements may not be shown in the interest of clarity and conciseness. In some of the figures, in order to improve clarity and conciseness, one or more components or aspects of a component may be omitted or may not have reference numerals identifying the features or components. In addition, within the specification, including the drawings, like or identical reference numerals may be used to identify common or similar elements.

As used herein, including in the claims, the terms "including" and "comprising," as well as derivations of these, are used in an open-ended fashion, and thus are to be interpreted to mean "including, but not limited to . . . ." Also, the term "couple" or "couples" means either an indirect or direct connection. Thus, if a first component couples or is coupled to a second component, the connection between the components may be through a direct engagement of the two components, or through an indirect connection that is accomplished via other intermediate components, devices and/or connections. The recitation "based on" means "based at least in part on." Therefore, if X is based on Y, then X may be based on Y and on any number of other factors. The word "or" is used in an inclusive manner. For example, "A or B" means any of the following: "A" alone, "B" alone, or both "A" and "B." In addition, the terms "axial" and "axially" generally mean along a given axis, while the terms "radial" and "radially" generally mean perpendicular to the axis. For instance, an axial distance refers to a distance measured along or parallel to a given axis, and a radial distance means a distance measured perpendicular to the axis. As understood in the art, the use of the terms "parallel" and "perpendicular" may refer to precise or idealized conditions as well as to conditions in which the members may be generally parallel or generally perpendicular, respectively. As used herein, the terms "approximately," "about," "substantially," and the like mean within 10% (i.e., plus or minus 10%) of the recited value. Thus, for example, a recited angle of "about 80 degrees" refers to an angle ranging from 72 degrees to 88 degrees.

As previously described, bottom-founded offshore structures such as fixed platforms and gravity based offshore structures usually rely on their weight to maintain themselves in position at the installation site. Consequently, these structures are typically not buoyant, and thus, rely on cranes to position and install the substructure on the sea floor, and then to install the topside on top of the substructure. The use of crane barges to install the substructure and the topside can be time consuming and expensive. In addition, substructures without self-floatation capabilities are very difficult to remove during decommissioning, because the piles installed into the seafloor are difficult to cut or because concrete structures may crack during removal. Further, lateral ocean currents may induce sediment transport and erosion (scour) at the interface between the foundation and the seafloor, which may compromise foundation strength and platform stability. Scour is conventionally addressed via specialized dredging vessels, rock dumping vessels, and subsea installation vessels that are used to create a barrier along the perimeter of the foundation to prevent soil erosion by ocean currents. Typical scour protection systems may include, for example, rocks, concrete block mattresses, rubber mats, gravel bags, collars, etc. These vessels and services increase time and cost for offshore platform installation.

Embodiments described herein are directed to bottom-founded offshore structures comprising adjustably buoyant hulls with integral anti-scour plates and foundation skirts. The foundation skirts (including both column skirts and pontoon skirts) and anti-scour plates are integral to the hull and may be built in a shipyard prior to deployment of the hull. The anti-scour plates increase contact surface area with the seafloor, which increases the bearing capacity of the hull, as well as reduce scour along the perimeter of the hull. Embodiments of bottom-founded offshore structures described herein maintain their position (on the seafloor) by self-weighting, by shallow penetration foundations, friction of a large contact area with the seafloor, or combinations thereof. The bottom-founded offshore structures may include a self-flotation hull with a space between columns sufficient to allow a barge to install the topside without the use of crane barges. In addition, the bottom-founded offshore structures may include foundation skirts on both the columns and pontoons to increase total skirt area and reduce depth of the overall skirts. Still further, the bottom-founded offshore structures may include scour prevention devices integral to a hull bottom section, installed at the construction site, which eliminates the need of using specialized vessels for installation of scour protection systems.

Figure 2:
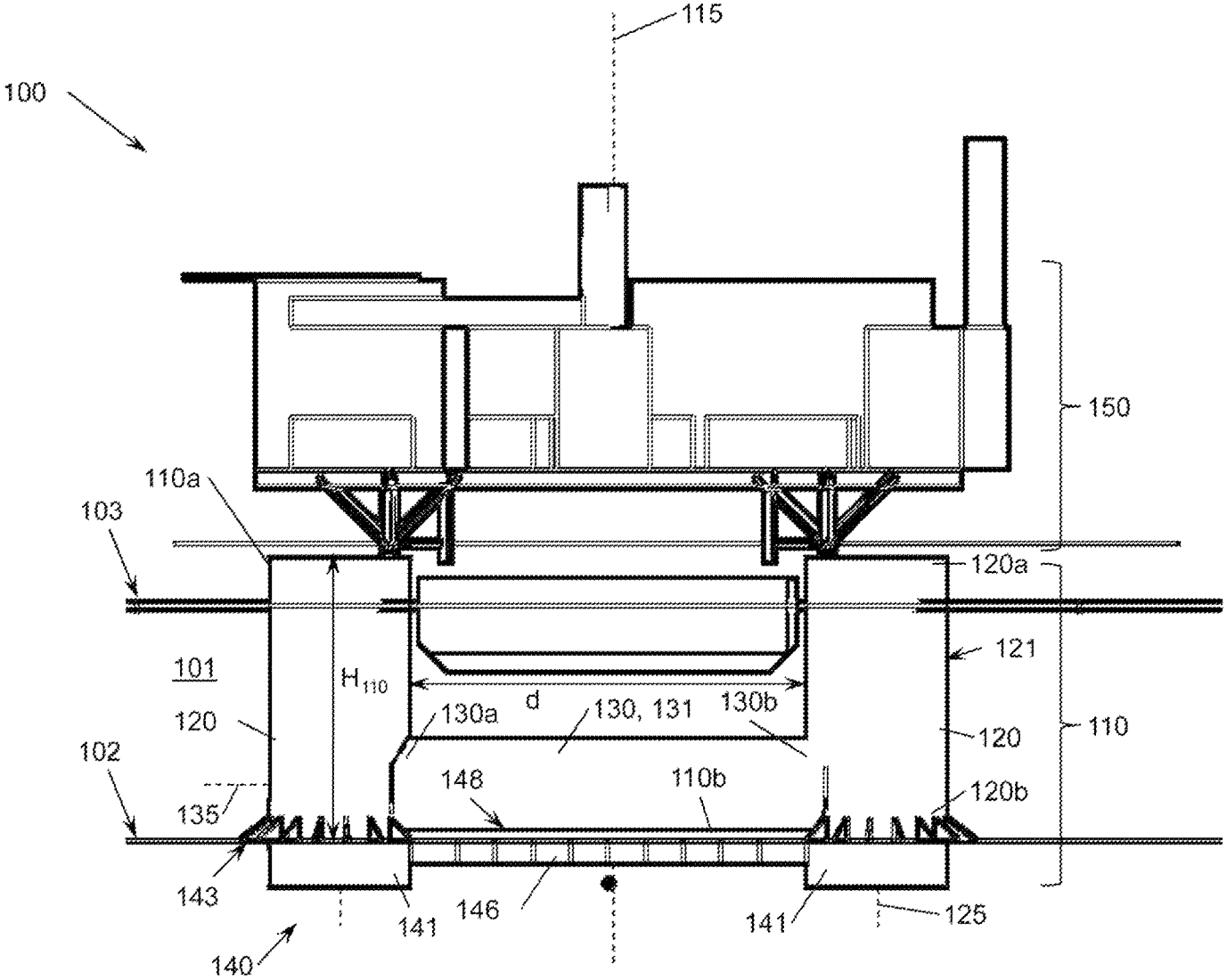
FIG. 2 is a side view of the offshore structure of FIG. 1.

Referring now to FIGS. 1 and 2, an embodiment of an offshore structure 100 in accordance with the principles described herein is shown. Structure 100 is deployed in a body of water 101 and releasably secured to the sea floor 102 at an offshore site. Consequently, tower 100 may be referred to as a "bottom-founded" structure, it being understood that bottom-founded offshore structures are anchored directly to the sea floor and do not rely on mooring systems to maintain their position at the installation site. In general, structure 100 may be deployed offshore to drill a subsea wellbore and/or produce hydrocarbons from a subsea well. In this embodiment, structure 100 includes an adjustably buoyant hull 110 and a topside or deck 150 mounted to hull 110 above the sea surface 103. In general, the equipment used in oil and gas drilling or production operations, such as, for example, a derrick, draw works, shale shakers, pumps, and the like is disposed on and supported by topside 150.

Figure 3:
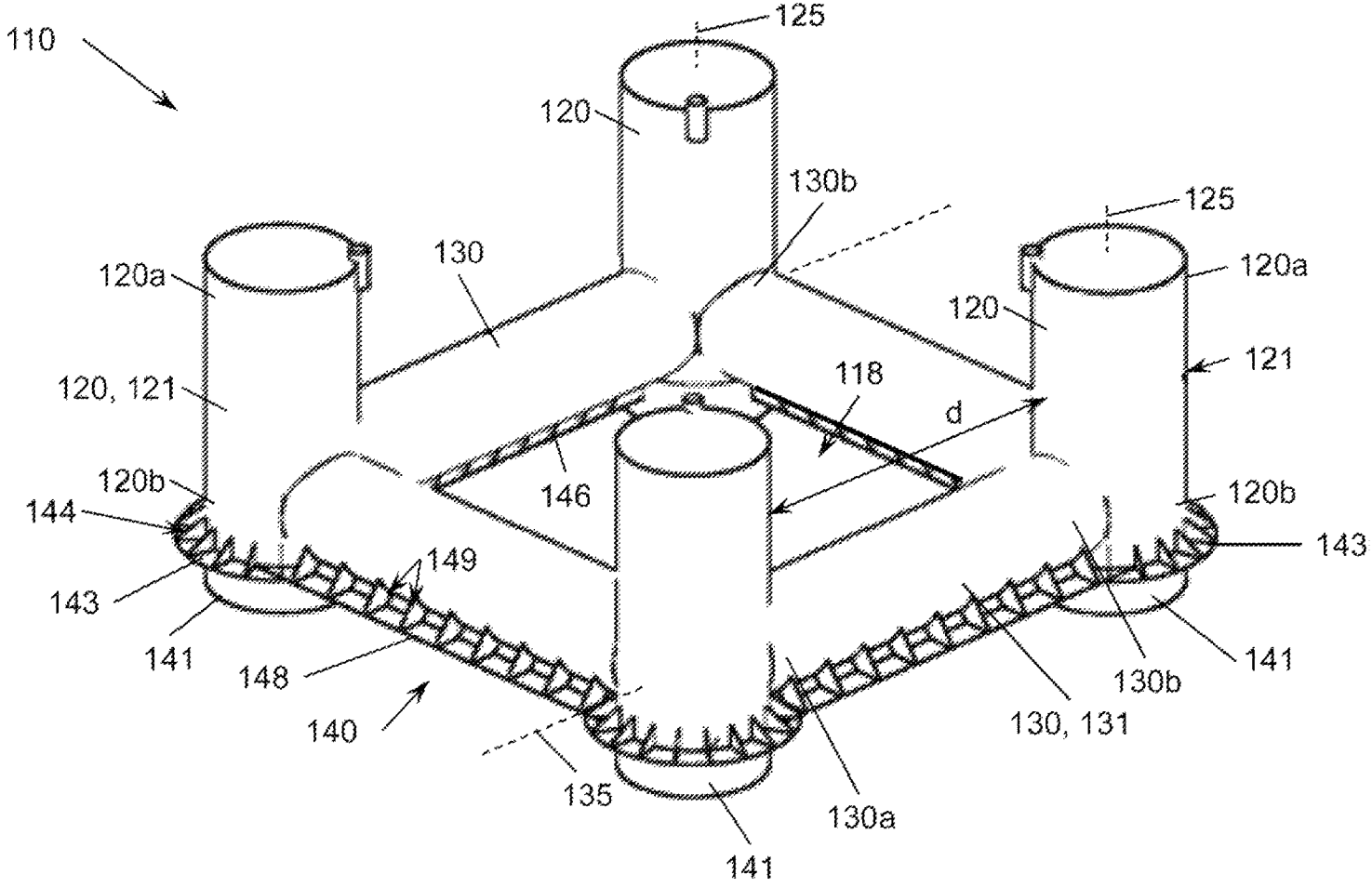
FIG. 3 is a top perspective view of the hull of the offshore structure of FIG. 1.

Referring now to FIGS. 1-3, hull 110 has a vertically oriented central axis 115, a first or upper end **110*a* extending above the sea surface 103, and a second or lower end 110*b*. Hull 110 is directly and releasably secured to the sea floor 102 with a foundation assembly 140 disposed along lower end 110*b*. Hull 110 has a vertical height $H_{110}$ measured axially (vertically) from end 110*b* to end 110*a*. Height $H_{110}$ is greater than the depth of water 101 to ensure topside 150 is positioned above the surface 103 of water 101. In general, the height $H_{110}$ can be varied for installation in various water depths. However, embodiments of structure 100** described herein are particularly suited for deployment and installation in water depths ranging from about 30 feet to 200 feet.

Hull 110 includes a plurality (e.g., at least three) circumferentially-spaced vertical columns 120 and a plurality (e.g., at least three) of horizontal pontoons 130. Each pontoon 130 extends between the lower portions of each pair of circumferentially-adjacent columns 120, thereby forming a central opening 118 (FIG. 3) through which vertical risers may pass upward through hull 110 to topsides 150. Although four pontoons 130 are provided and central opening 118 has a square geometry in this embodiment, in other embodiments, a different number of pontoons (e.g., pontoons 130) can be provided and the central opening (e.g., central opening 118) can have a different geometric shape such as rectangular, triangular, etc.

Each outer column 120 has a central or longitudinal axis 125 oriented parallel to axis 115, a first or upper end 120*a* extending above the sea surface 103, and a second or lower end 120*b* opposite end 120*a*. Upper ends 120*a* define upper end 110*a* of hull 110 and lower ends 120*b* (in conjunction with pontoons 130) define lower end 110*b* of hull 110. Topside 150 is fixably attached to upper ends 120*a* of column 120. In addition, each column 120 has a radially outer surface 121 extending between ends 120*a*, 120*b*. In this embodiment, outer surface 121 of each column 120 is cylindrical, however, in other embodiments, the outer surfaces of the columns (e.g., outer surfaces 121 of columns 120) may have other geometries. Each column 120 includes a plurality of vertically stacked ballast tanks separated by bulkheads. The ballast tanks of each column 120 can be selectively filled with ballast water and/or air to adjust the buoyant force applied to hull 110.

As shown in FIGS. 2 and 3, each pair of circumferentially-adjacent columns 120 is spaced apart by a horizontal distance d. As will be described in more detail below, topside 150 is carried to the installation site on a barge and mounted to upper end 110*a* of hull 110 with the barge. Accordingly, the distance d between each pair of circumferentially-adjacent columns 120 is preferably greater than the width of the barge to enable the barge to pass between columns 120 carrying topside 150. To accommodate most barges, distance d is preferably at least 65 feet.

Figure 4:
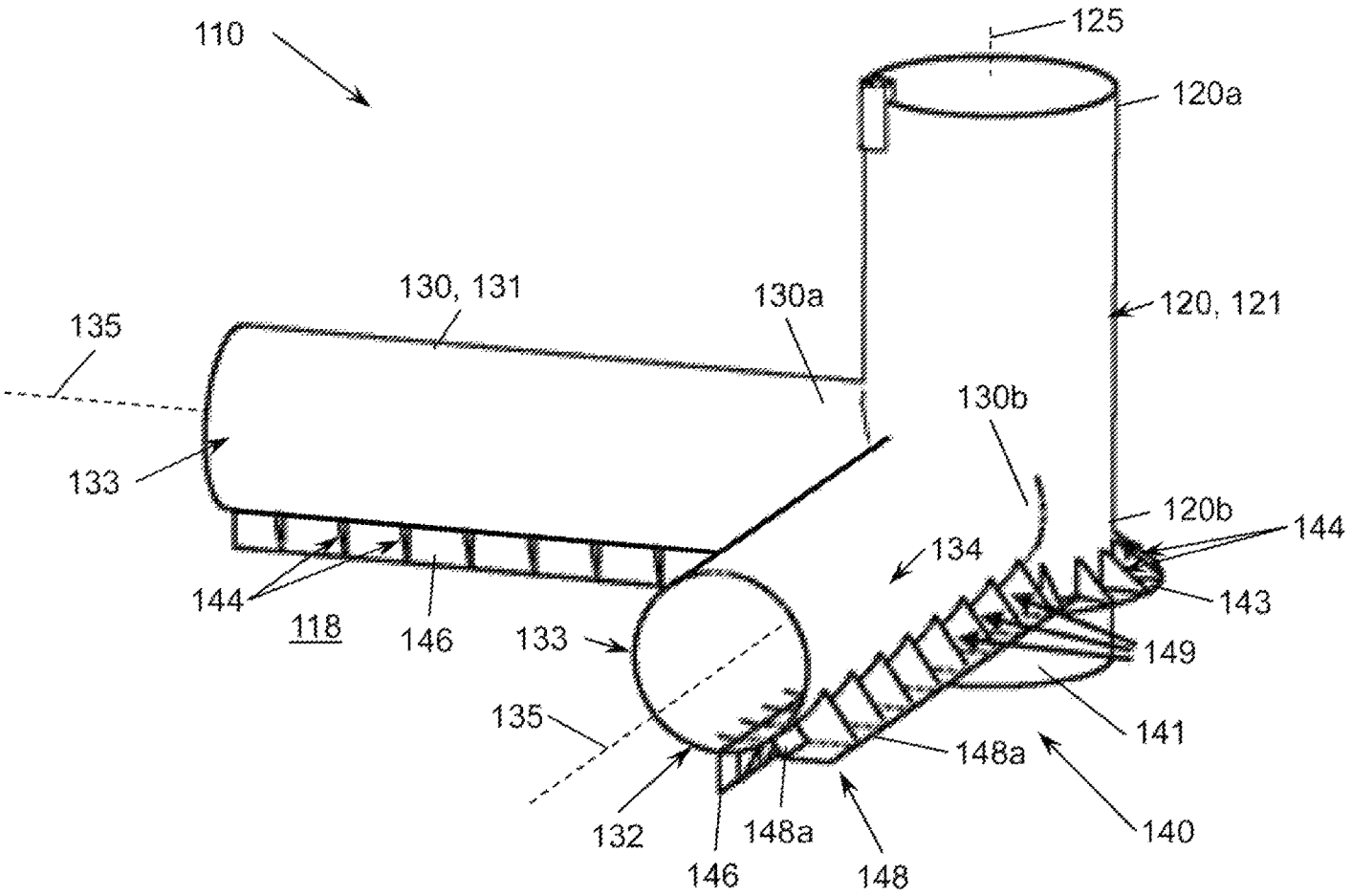
FIG. 4 is a perspective partial view of the hull of FIG. 3.

Referring still to FIGS. 1-3, each pontoon 130 has a central or longitudinal axis 135 oriented perpendicular to axes 115, 125 in side view, a first end 130*a* coupled to the lower end 120*b* of one column 120, and a second end 130*b* coupled to the lower end 120*b* of a circumferentially adjacent column 120. In addition, each pontoon 130 has a radially outer surface 131 extending between ends 130*a*, 130*b*. In this embodiment, outer surface 131 of each pontoon 130 is cylindrical, however, in other embodiments, the outer surfaces of the pontoons (e.g., outer surfaces 131 of pontoons 130) may have other geometries. As best shown in FIG. 4, outer surface 131 may be described as having a lower or bottom surface 132, a radially inner lateral side 133 (relative to axis 115) facing toward opening 118, and a radially outer lateral side 134 (relative to axis 115) facing away from opening 118. Each pontoon 130 includes a plurality of horizontally adjacent ballast tanks separated by bulkheads. The ballast tanks of the pontoons 130 can be selectively filled with ballast water and/or air to adjust the buoyant force applied to hull 110.

Referring now to FIG. 4, foundation assembly 140 is fixably secured to lower end 110*b* of hull 110, and in particular, is fixably secured to lower ends 120*b* of columns 120 and bottom surfaces 132 of pontoons 130. In general, foundation assembly 140 directly engages the sea floor 102 to secure hull 110 and structure 100 thereto, as well as maintains the position of hull 110 and structure 100 at the installation site by resisting lateral loads applied to structure 100. In this embodiment, the weight of hull 110 and structure 100 bearing down on the sea floor 102 in combination with foundation assembly 140 resist lateral loads applied to structure 100, thereby enabling structure 100 to maintain its position at the installation site without a mooring system.

In this embodiment, foundation assembly 140 includes a plurality of columns skirts 141, a plurality of column anti-scour plates 143, a plurality of pontoon skirts 146, and a plurality of pontoon anti-scour plates 148. A column skirt 141 and a column anti-scour plate 143 is provided on each column 120, and a pontoon skirt 146 and a pontoon anti-scour plate 148 is provided on each pontoon 130. Skirts 141, 146 extend vertically and axially downward (relative to axis 115) from hull 110, and in particular, from columns 120 and pontoons 130, respectively. Anti-scour plates 143, 148 extend horizontally and radially outward (relative to axis 115) from the outer perimeter of hull 110, and in particular, from columns 120 and pontoons 130, respectively. Skirts 141, 146 and plates 143, 148 are made of rigid materials (e.g., metal or metal alloys) and are fixably coupled to hull 110 such that they do not move translationally or rotationally relative to hull 110.

Referring still to FIG. 4, one skirt 141 and one anti-scour plate 143 extend from each column 120. Each column skirt 141 and column anti-scour plate 143 is the same, and thus, one skirt 141 and one plate 143 will be described it being understood the other column skirts 141 and column plates 143, respectively, are the same. Column skirt 141 is coaxially aligned with the corresponding column 120 and extends axially (relative to axis 125) from lower end 120*b* thereof. The upper end of skirt 141 is fixably attached to (or monolithically formed with) lower end 120*b* of the corresponding column 120 and the lower end of skirt 141 is distal the corresponding column 120. In addition, in this embodiment, skirt 141 has the same cross-sectional geometry as the corresponding column 120 and extends contiguously from the outer perimeter of the corresponding column 120. Accordingly, in this embodiment, skirt 141 is cylindrical (circular cross-sectional shape) and has the same outer diameter as outer surface 121 of column 120. Skirt 141 is open at its lower end. In this embodiment, skirt 141 has a uniform width measured vertically between its upper and lower ends.

Anti-scour plate 143 extends laterally or horizontally from outer surface 121 of the corresponding column 120 at lower end 120*b* (at or immediately above the upper end of the corresponding column skirt 141). In this embodiment, a plurality of circumferentially-spaced, rigid, support brackets or fins 144 extend between column 120 and plate 143. In particular, brackets 144 extend downward from outer surface 121 of column 120 to the upper surface of plate 143. Brackets 144 support plate 143 and help maintain the rigidity and integrity of plate 143 under vertical load. In this embodiment, plate 143 has a uniform horizontal width and generally follows the contours of outer surface 121 of column 120.

Referring still to FIG. 4, one skirt 146 and one anti-scour plate 148 extends from each pontoon 130. Each pontoon skirt 146 and pontoon anti-scour plate 148 is the same, and thus, one skirt 146 and one plate 148 will be described it being understood the other pontoon skirts 146 and pontoon plates 148, respectively, are the same. Pontoon skirt 146 is oriented parallel to axis 135 of the corresponding pontoon 130 and extends radially (relative to axis 135) and downward from bottom surface 132 of the corresponding pontoon 130. In particular, the upper end of skirt 146 is fixably attached to bottom surface 132 of the corresponding pontoon 130 and the lower end of skirt 146 is distal the corresponding pontoon 130. In addition, skirt 146 of each pontoon 130 extends axially (relative to axis 135) between ends 130*a*, 130*b* of the corresponding pontoon 130 and column skirts 141 of the circumferentially-adjacent columns 120. In this embodiment, a plurality of axially spaced (relative to axis 135) rigid brackets or fins 147 extend from outer surface 131 of pontoon 130 to skirt 146. Brackets 147 are disposed on both sides of skirt 146. Brackets 147 help maintain the rigidity and integrity of plate 146 under horizontal load. In this embodiment, skirt 146 is a rectangular plate having a uniform width measured vertically between its upper and lower ends.

Anti-scour plate 148 includes a first portion 148*a* extending generally down and radially outward (relative to axis 115) from bottom surface 132 of the corresponding pontoon 130 and a second portion 148*b* extending horizontally outward from first portion 148*a*. Second portion 148*b* is oriented at an oblique angle (e.g., 135°) relative to first portion 148*a*. In addition, plate 148 of each pontoon 130 extends axially (relative to axis 135) between ends 130*a*, 130*b* of the corresponding pontoon 130, and second portion 148*b* is contiguous with and extends axially (relative to axis 135) between column anti-scour plates 143 of the adjacent columns 120. In this embodiment, a plurality of circumferentially-spaced, rigid, support brackets or fins 149 extend downward from radially outer lateral surface 134 of pontoon 130 to the upper surface of plate 148. Brackets 149 support plate 148 and help maintain the rigidity and integrity of plate 148 under vertical load. In this embodiment, plate 148 has a uniform horizontal width. As best shown in FIGS. 2 and 3, in this embodiment, anti-scour plates 143, 148 connect end-to-end and extend around the entire outer perimeter of hull 110 at lower end 110*b*. In addition, in this embodiment, each anti-scour plate 143, 148 lies in a common horizontal plane oriented perpendicular to axes 115, 125.

As will be described in more detail below, during installation of hull 110, skirts 141, 146 penetrate vertically into the sea floor 102 and plates 143, 148 bear against the upper surface of sea floor 102 as hull 110 is seated against the sea floor 102. Skirts 141, 146 bear horizontally against the material forming the sea floor 102, and thus, resist lateral loads (e.g., wind, waves, sea currents) experienced by hull 110. Plates 143, 148 increase the contact surface area with sea floor 102, and thus, increase the vertical bearing capacity of hull 110. Brackets 144, 147, 149 support plates 143, skirts 146, and plates 148, respectively, and increase the rigidity of plates 143, skirts 146, and plates 148, respectively, as they come into contact with the sea floor 102. In addition, with anti-scour plates 143, 148 disposed on the sea floor 102 and extending outward from columns 120 and pontoons 130, respectively, plates 143, 148 extend over and cover the sea floor 130 along the outer perimeter of hull 110, thereby reducing and/or preventing erosion of the sea floor 102 around the perimeter of hull 110. In particular, the plates 143, 148 shield the soil, gravel, and rock on the sea floor 102 around the outer perimeter of hull 110 from subsea water currents.

Figure 5:
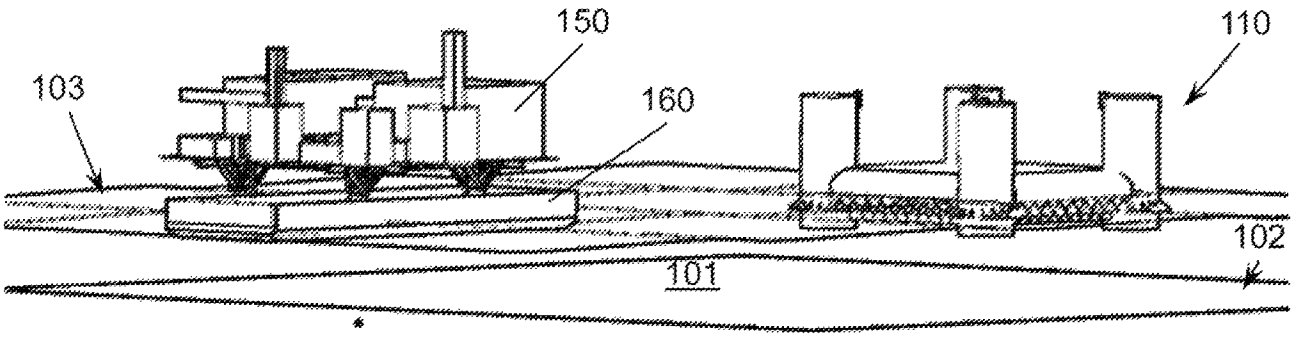
FIGS. 5-9 are sequential perspective views of the deployment and installation of the offshore structure of FIG. 1.
Figure 6:
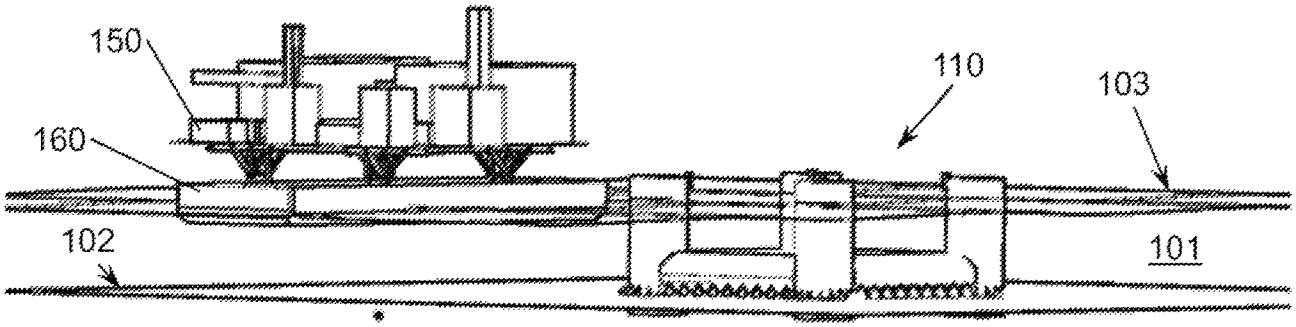
Figure 7:
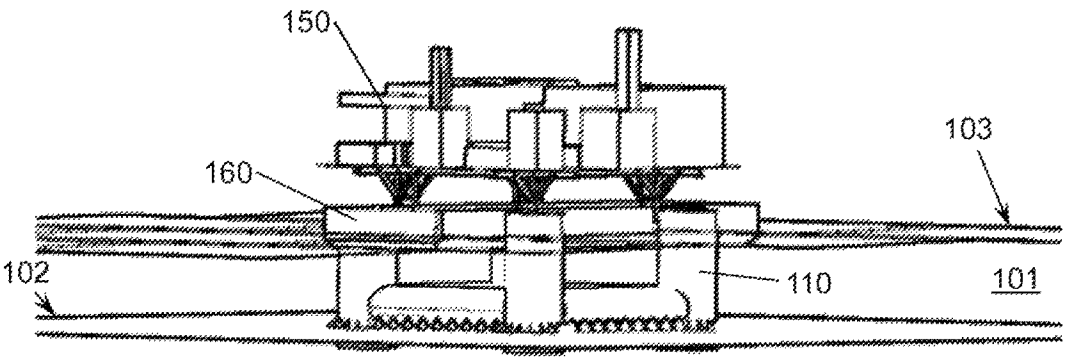
Figure 8:
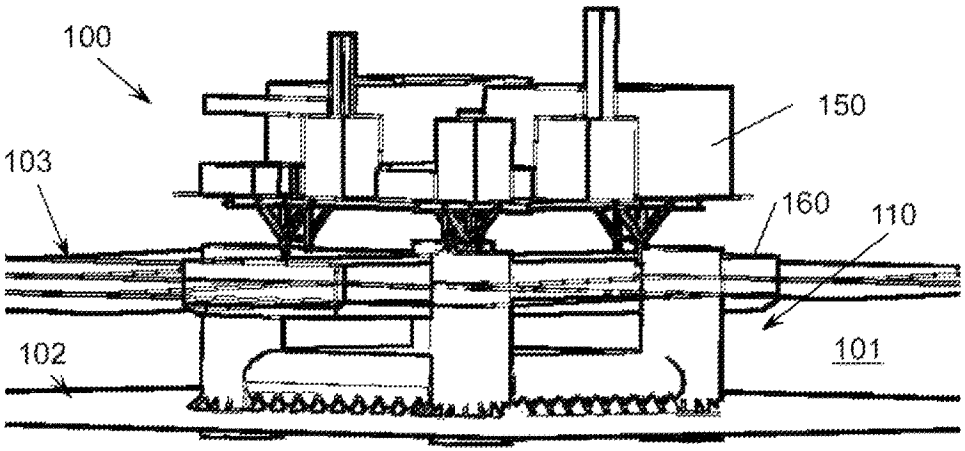
Figure 9:
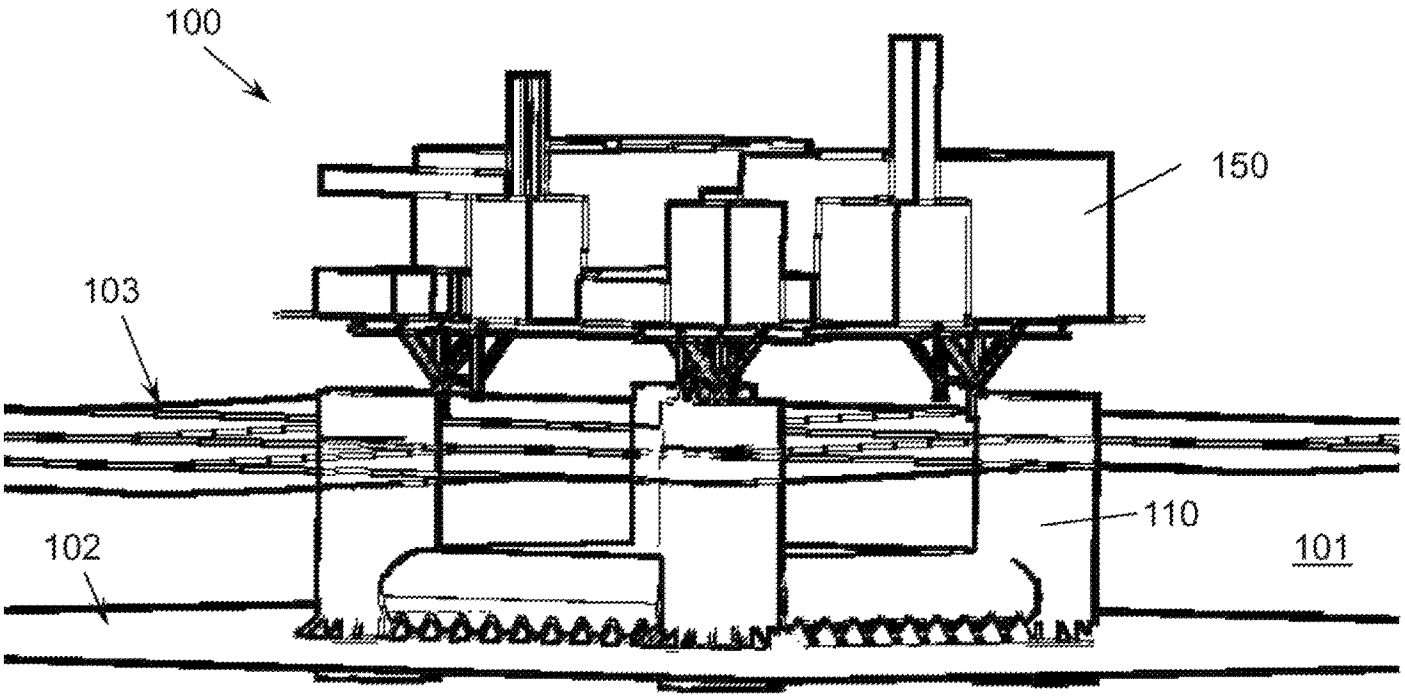

Referring now to FIGS. 5-9, the deployment and installation of offshore structure 100 is shown. More specifically, FIG. 5 illustrates the separate and independent deployment of topside 150 and hull 110 to the installation site (e.g., wellsite), FIG. 6 illustrates the installation of hull 110 at the installation site, and FIGS. 7-9 illustrate the mating of the topside 150 and hull 110 at the installation site to form structure 100. As previously described, the relative amounts of ballast water and air in columns 120 and pontoons 130 can be controllably and selectively adjusted to vary the buoyant force applied to hull 110. Without being limited by this or any particular theory, and assuming topside 150 is not mounted to hull 110, if the total buoyant force applied to hull 110 is equal to or greater than the weight of hull 110, then hull 110 will float; however, if the total buoyant force applied to hull 110 is less than the weight of hull 110, then hull 110 will sink.

Referring now to FIG. 5, in this embodiment, topside 150 and hull 110 are manufactured separately (e.g., at the same shipyard or different shipyards) and separately transported to the installation site. In particular, topside 150 is disposed on a barge 160 and transported to the installation site on the barge 160, while hull 110 is floated out to the installation site (e.g., towed or pushed via a tug boat). The buoyant force applied to hull 110 is adjusted via columns 120 and pontoons 130 such that hull 110 floats (e.g., the buoyant force applied to hull 110 exceeds the weight of hull 110), and can then be pushed or towed to installation site.

Moving now to FIG. 6, hull 110 is floated over the desired installation location at the installation site, and then ballasted (e.g., chamber(s) within columns 120 and/or pontoons 130 are flooded) to reduce the buoyant force applied to hull 110 below the weight of hull 110 such that hull 110 descends to the sea floor 102. As lower end 110*b* of hull 110 approaches the sea floor 102, skirts 141, 146 penetrate the sea floor 102 and anti-scour plates 143, 148 bear against the top of the sea floor 102, thereby allowing foundation assembly 140 to removably secure hull 110 to the sea floor 102 while simultaneously reducing and/or preventing erosion around the perimeter of hull 110 at lower end 110*b*.

Next, as shown in FIG. 7, barge 160 is advanced between a pair of columns 120 with topside 150 positioned above upper end 110*a* of hull 110. Barge 160 maneuvers between columns 110 to position topside 150 directly over upper ends 120*a* of columns 120. It should be appreciated that the distance d between columns 120 allows barge 160 to pass therebetween. Topside 150 has a width that is greater than distance d, however, topside 150 is disposed above upper ends 120*a* of columns 120, and thus, columns 120 do not contact or otherwise interfere with the positioning of topside 150 above upper ends 120*a*. With topside 150 positioned at the desired location above upper ends 120*a*, barge 160 is ballasted to lower barge 160 and lower topside 150 relative to sea surface 103, and simultaneously lower topside 150 onto upper ends 120*a* of columns 120, thereby forming offshore structure 100 as shown in FIG. 8. As topside 150 is lowered onto columns 120, the weight of topside 150 is transferred from barge 160 to hull 110, which may increase the vertical load on hull 110 and push hull 110 downward into further reengagement with the sea floor 102. The height $H_{110}$ of hull 110 is greater than the depth of water 101 at the installation site, and thus, topside 150 is positioned above the water surface 103 when mounted to hull 110 atop columns 120. Moving now to FIG. 9, with topside 150 securely mounted to hull 110 and the weight of topside 150 transferred to hull 110, barge 160 can be ballasted below topside 150 such that it is completely clear of topside 150, and can then pass freely between columns 120, thereby completing the installation of offshore structure 100.

In the manner described, topside 150 and hull 110 are transported to the installation site independently and assembled at the installation site to form structure 100. In general, the process shown in FIGS. 5-9 and described above can be performed in reverse to uninstall structure 100 and effectively move structure to a different offshore location.

While exemplary embodiments have been shown and described, modifications thereof can be made by one of ordinary skill in the art without departing from the scope or teachings herein. The embodiments described herein are exemplary only and are not limiting. Many variations, combinations, and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. The inclusion of any particular method step or operation within the written description or a figure does not necessarily mean that the particular step or operation is necessary to the method. The steps or operations of a method listed in the specification or the claims may be performed in any feasible order, except for those particular steps or operations, if any, for which a sequence is expressly stated. In some implementations two or more of the method steps or operations may be performed in parallel, rather than serially. The recitation of identifiers such as (a), (b), (c) or (1), (2), (3) before operations in a method claim are not intended to and do not specify a particular order to the operations, but rather are used to simplify subsequent reference to such operations.

What is claimed is:

1. An offshore structure, wherein the offshore structure is a bottom-founded structure comprising:

an adjustably buoyant hull including a plurality of vertical columns and a plurality of horizontal pontoons, wherein each pontoon extends between a pair of the columns, wherein the adjustably buoyant hull is configured to receive a topside;

wherein each column has a central axis, an upper end, and a lower end;

wherein each pontoon has a longitudinal axis, a first end coupled to one of the columns, and a second end coupled to another one of the columns;

a foundation assembly attached to a lower end of the hull and configured to directly engage a sea floor and secure the hull to the sea floor, wherein the foundation assembly includes:

a column skirt extending downward from the lower end of each column, wherein each column skirt includes an open lower end and is configured to penetrate the sea floor; and a pontoon skirt extending downward from a bottom surface of each pontoon, wherein each pontoon skirt is configured to penetrate the sea floor;

a first plurality of anti-scour plates, wherein each of the first plurality of anti-scour plates extends horizontally from one of the columns and is configured to bear against the sea floor;

a second plurality of anti-scour plates, wherein each of the second plurality of anti-scour plates extends horizontally from one of the pontoons and is configured to bear against the sea floor;

wherein each of the anti-scour plates is positioned along an outer perimeter of the hull at the lower end of the hull;

wherein the first plurality of anti-scour plates and the second plurality of anti-scour plates connect end-to-end and extend continuously around the entire outer perimeter of the hull at the lower end of the hull.

2. The offshore structure of claim 1, wherein the foundation assembly comprises:

a first plurality of support brackets extending vertically from the columns to the first plurality of anti-scour plates; and a second plurality of support brackets extending vertically from the pontoons to the second plurality of anti-scour plates.

3. The offshore structure of claim 1, wherein a first plurality of the brackets extend from the pontoons to the anti-scour plates extending from the pontoons.

4. The offshore structure of claim 1, wherein each pontoon and each column is adjustably buoyant.

5. The offshore structure of claim 1, wherein each column and each pontoon has a cylindrical shape.

6. The offshore structure of claim 1, wherein each of the anti-scour plates lies in a common horizontal plan.

* * * * *